US008045904B2

(12) United States Patent
Shirakata

(10) Patent No.: US 8,045,904 B2
(45) Date of Patent: Oct. 25, 2011

(54) APPARATUS WITH A STEERABLE BELT MEMBER ADJUSTING FEATURE

(75) Inventor: Jiro Shirakata, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 365 days.

(21) Appl. No.: 12/336,955

(22) Filed: Dec. 17, 2008

(65) Prior Publication Data

US 2009/0162098 A1 Jun. 25, 2009

(30) Foreign Application Priority Data

Dec. 20, 2007 (JP) ..... 2007-328856

(51) Int. Cl.
*G03G 15/01* (2006.01)
*G03G 15/16* (2006.01)

(52) U.S. Cl. ..... 399/302

(58) Field of Classification Search ..... 399/302, 399/308, 329, 312, 303
See application file for complete search history.

(56) References Cited

U.S. PATENT DOCUMENTS

| | | | | |
|---|---|---|---|---|
| 6,321,052 | B1 * | 11/2001 | Yamashina et al. | 399/165 |
| 7,920,814 | B2 * | 4/2011 | Atwood et al. | 399/302 |
| 2007/0019979 | A1 * | 1/2007 | Fujii et al. | 399/67 |

FOREIGN PATENT DOCUMENTS

| | | | |
|---|---|---|---|
| JP | 04133929 | A * | 5/1992 |
| JP | 09110229 | A * | 4/1997 |
| JP | 2000-233843 | A | 8/2000 |
| JP | 2001-147601 | A | 5/2001 |

* cited by examiner

*Primary Examiner* — Quana M Grainger
(74) *Attorney, Agent, or Firm* — Fitzpatrick, Cella, Harper & Scinto

(57) ABSTRACT

A steering mechanism moves an intermediary transfer belt in its width direction by moving an inclination angle of two steering rollers with respect to a rotational direction of the intermediary transfer belt. The two steering rollers changes the inclination angle while maintaining a rectangle defined by the steering rollers and bearing arms to ensure a thrust movement distance in a period from start of winding of one of the steering rollers and end of winding of the other steering roller.

6 Claims, 11 Drawing Sheets

APPARATUS WITH A STEERABLE BELT MEMBER ADJUSTING FEATURE

FIELD OF THE INVENTION AND RELATED ART

The present invention relates to an image forming apparatus for dynamically positioning a rotating belt member with respect to its width direction by changing an inclination angle of a rotatable steering member. Specifically, the present invention relates to a structure for increasing a widthwise movement distance of the belt member with respect to an amount of the change in inclination angle.

An image forming apparatus for transferring a toner image from an image bearing member onto a recording material carried on a recording material conveying belt and an image forming apparatus for secondary-transferring a toner image, which has been primary-transferred from an image bearing member onto an intermediary transfer belt, from the intermediary transfer belt onto a recording material has been put into practical use. Further, an image forming apparatus for heat-fixing a toner image, which has been transferred onto a recording material, on the recording material by nip-conveying the recording material by a fixing belt has been put into practical use.

With respect to such belt members, a steering mechanism for dynamically positioning a rotating belt member with respect to its width direction by changing an inclination angle of a rotatable steering member has been put into practical use.

Japanese Laid-Open Patent Application (JP-A) 2000-233843 discloses an image forming apparatus for positioning a rotating intermediary transfer belt in its width direction by using a steering mechanism. In this image forming apparatus, two rotatable steering members are disposed with a spacing therebetween with respect to a rotational direction of the belt member and are interrelated with each other but inclination angles of the two rotatable steering members with respect to the rotational direction of the belt member are controlled in different directions.

JP-A 2001-147601 discloses a steering mechanism for cancelling a fluctuation in tension caused by inclination of a rotatable steering member by controlling an amount of inclination of a rotatable tension member disposed at a position separated from a belt member with respect to a rotational direction of the belt member.

When the rotatable steering member is inclined at an angle $\theta$ with respect to the rotational direction of the belt member, a widthwise movement distance is a length obtained by multiplying a contact (winding) length of the belt member by cos $\theta$, so that the widthwise movement distance is longer with a longer contact length.

In order to increase the contact length of the belt member with respect to the rotatable steering member, an angle of contact of the belt member is increased or a diameter of the rotatable steering member is increased.

However, when the angle of contact of the belt member is increased, the rotatable steering member largely projects outwardly, thus being less liable to be accommodated in the image forming apparatus.

On the other hand, when the diameter of the rotatable steering member is increased, the rotatable steering member interferes with another rotatable member for supporting the belt member, thus being less liable to be accommodated in the image forming apparatus.

Therefore, in either case, it is not easy to incorporate the rotatable steering member into a belt member driving mechanism around which many devices are disposed with a determined rotational path.

SUMMARY OF THE INVENTION

A principal object of the present invention is to provide an image forming apparatus capable of increasing a movement distance of a belt member with respect to an inclination angle of a steering member while downsizing the image forming apparatus.

According to an aspect of the present invention, there is provided an image forming apparatus comprising:

a rotatable belt member;

a rotatable supporting member for supporting the belt member;

a first rotatable steering member for adjusting a position of the belt member with respect to a rotational axis direction of the belt member by contacting an inner surface of the belt member and inclining with respect to the rotational axis direction of the belt member;

a second rotatable steering member for adjusting the position of the belt member with respect to the rotational axis direction of the belt member by contacting the inner surface of the belt member and inclining with respect to the rotational axis direction of the belt member; and an interrelating portion for interrelating an inclining operation of the first rotatable steering member and an inclining operation of the second rotatable steering member with each other so that the first rotatable steering member and the second rotatable steering member incline in the same direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, several embodiments of the present invention will be described in detail with reference to the drawings.

The image forming apparatus according to the present invention can also be realized in other embodiments in which a part or all of constituents of the respective embodiments are replaced with their alternative constituents so long as a position of a belt member with respect to its width direction can be dynamically controlled. Therefore, the present invention can be carried out even when the belt member is not only an intermediary transfer belt but also a recording material conveying belt, a photosensitive belt, a transfer belt, a secondary transfer belt, a fixing belt, and the like.

The present invention can also be carried out by not only a tandem-type full-color image forming apparatus but also an image forming apparatus including a plurality of developing devices provided with respect to a single image bearing member and an image forming apparatus including three or less image bearing members provided with respect to an intermediary transfer member or a recording material conveying member.

In the following embodiments, only a principal portion concerning formation/transfer of the toner image will be described but the present invention can be carried out in various uses including printers, various printing machines, copying machines, facsimile machines, multi-function machines, and so on by adding necessary equipment, options, or casing structures.

Incidentally, general matters of the image forming apparatus described in JP-A 2000-233843 and JP-A 2001-147601 will be omitted from the following description, thus omitting a redundant explanation.

First Embodiment

Figure 1:
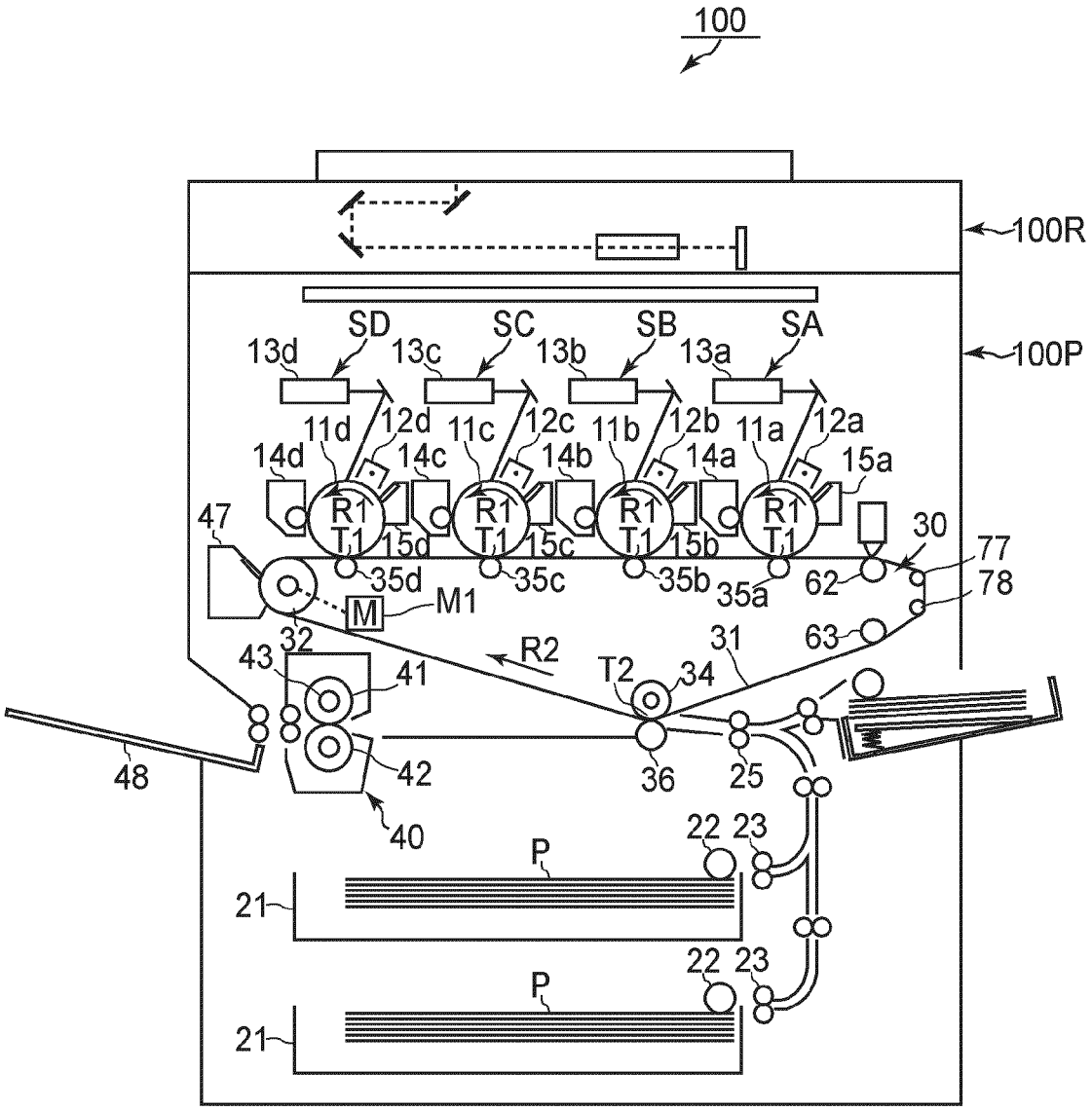
FIG. 1 is a schematic view for illustrating a structure of an image forming apparatus of a First Embodiment.

FIG. 1 is a schematic view for illustrating a structure of an image forming apparatus of a First Embodiment.

As shown in FIG. 1, an image forming apparatus 100 of the First Embodiment is a tandem-type full-color copying machine of an intermediary transfer type in which four image forming stations SA, SB, SC and SD are arranged in a linear section of an intermediary transfer belt 31.

In the image forming station SD, a yellow toner image is formed on a photosensitive drum 11*a* and then is primary-transferred onto the intermediary transfer belt 31. In the image forming station SC, a magenta toner image is formed on a photosensitive drum 1*b* and is primary-transferred onto the yellow toner image on the intermediary transfer belt 31 in a superposition manner. In the image forming stations SB and SA, a cyan toner image and a black toner image are formed on photosensitive drums 11*c* and 11*d*, respectively, and are successively primary-transferred onto the magenta toner image on the intermediary transfer belt 31 in the superposition manner similarly as in the case of the image forming station SC.

The four-color toner images primary-transferred on the intermediary transfer belt 31 are conveyed to a secondary transfer portion T2, at which the toner images are collectively secondary-transferred onto a recording material P which has been fed to the secondary transfer portion T2. The four-color toner images secondary-transferred on the surface of the recording material P are fixed by a fixing device 40, which is then discharged on the tray 48.

A separating device 23 separates the recording material P, one-by-one, picked up by a pick-up roller 22 from a sheet-feeding cassette 21 to feed the separated sheet toward registration rollers 25.

The registration rollers 25 in-convey to the secondary transfer portion T2 while timing the recording material P to the toner image on the intermediary transfer belt 31.

The intermediary transfer belt 31 is extended around a driving roller 32, steering rollers 77 and 78, a back-up roller 34, and supporting rollers 62 and 63 and is movably supported with respect to a width direction thereof. The intermediary transfer belt 31 is driven by a motor M1 for rotating the driving roller 32 and is rotated in a direction of an indicated arrow R2 at a predetermined process speed.

The intermediary transfer belt 31 is formed, with a thickness of 100 μm and in an endless form, of a polyimide (PI) resin material containing carbon black for imparting resistivity to the intermediary transfer belt 31. The intermediary transfer belt 31 may also be formed of polyvinylidene fluoride (PVdF) or the like.

The image forming stations SA, SB, SC and SD have the substantially same constitution except that the colors of toners of black for a developing device 4*a* provided in the image forming station SA, cyan for a developing device 14*b* provided in the image forming station SB, magenta for a developing device 14*c* provided in the image forming station SC, and yellow for a developing device 14*d* provided in the image forming station SD are different from each other. In the following description, the image forming station SA will be described and with respect to other image forming stations SB, SC and SD, the suffix a of reference numerals (symbols) for representing constituent members (means) is to be read as b, c and d, respectively, for explanation of associated ones of the constituent members.

The image forming station SA includes the photosensitive drum 11*a*. Around the photosensitive drum 11*a*, a primary charging device 12*a*, an exposure device 13*a*, the developing device 14*a*, a primary transfer roller 35*a*, and a cleaning device 15*a* are disposed in the image forming station SA.

The photosensitive drum 11*a* is prepared by forming a photosensitive layer having a negative charge polarity on an outer peripheral surface of an aluminum-made cylinder. The photosensitive drum 11*a* is rotatably supported at both end portions thereof and is rotated in a direction of an arrow R1 by transmitting a driving force from an unshown driving motor to one of the end portions.

The primary charging device 12*a* electrically charges the surface of the photosensitive drum 11*a* uniformly to a negative-polarity potential.

The exposure device 13*a* writes (forms) an electrostatic image for an image on the charged surface of the photosensitive drum 11*a* by scanning of the charged surface through a polygonal mirror with a laser beam obtained by ON/OFF modulation of scanning line image data expanded from a separated color image for black.

The developing device 14*a* deposits the negatively-charged toner on an exposed portion of the electrostatic image by supplying the negatively-charged toner to the photosensitive drum 11*a*. As a result, the electrostatic image is reversely developed.

The primary transfer roller 35*a* presses the intermediary transfer belt 31 against the photosensitive drum 11*a* to form a primary transfer portion T1 between the photosensitive drum 11*a* and the intermediary transfer belt 31.

A positive DC voltage is applied to the primary transfer roller 35*a* when the toner image carried on the photosensitive drum 11*a* passes through the primary transfer portion T1, so that the toner image is primary-transferred onto the intermediary transfer belt 31.

The primary transfer roller 35*a* is formed to have an outer diameter of 16 mm by covering a core metal having a diameter of 8 mm with a surface layer 35*h* of an urethane sponge adjusted to have a resistivity of $5\times10^7$ ohms by dispersing an ion-conductive agent in the urethane sponge.

The cleaning device 15*a* removes transfer residual toner which passed through the primary transfer portion T1 and remains on the surface of the photosensitive drum 11*a*.

The secondary transfer roller 36 is a rubber roller to which electroconductivity is imparted, and presses the intermediary transfer belt 31 against the back-up roller 34 to provide the secondary transfer portion T2 between the intermediary transfer belt 31 and the secondary transfer roller 36.

In a process in which the recording material P is nip-conveyed through the secondary transfer portion while the toner image on the intermediary transfer belt 31 is superposed on the recording material P, a positive-polarity voltage is applied from an unshown power source to the secondary transfer roller 36, so that the toner image carried on the intermediary transfer belt 31 is secondary-transferred onto the recording material P.

The back-up roller 34 is connected to the ground potential and bends a circulatory path of the intermediary transfer belt 31 on a downstream side of the secondary transfer portion T2, so that the recording material P attached to the intermediary transfer belt 31 is curvature-separated from the intermediary transfer belt 31.

The fixing device 40 presses a pressing roller 42 against a fixing roller 41 provided with a heat source 43 to create a fixing nip, so that the fixing device 40 fixes the toner image secondary-transferred on the recording material P on the recording material P while applying heat and pressure to the recording material P.

A cleaning device 47 removes transfer residual toner which passed through a secondary transfer portion T2 and remains on the intermediary transfer belt 31.

With respect to the intermediary transfer belt 31, movement of the intermediary transfer belt 31 in a belt width direction by rotation, i.e., a so-called lateral belt shifting is caused due to an alignment error or the like of a plurality of rotatable members for supporting an inner peripheral surface of the intermediary transfer belt 31.

When the lateral belt shifting is left standing, the intermediary transfer belt 31 is shifted to an outside of a supporting range by the rotatable members to cause breakage or partial dislodgement of the intermediary transfer belt 31. For this reason, in the image forming apparatus 100, the lateral belt shifting is corrected by steering control.

The steering control is a lateral belt shifting regulation method of a roller steering type in which inclination angles of the steering rollers 77 and 78 for supporting the inner peripheral surface of the intermediary transfer belt 31 are changed to correct the lateral belt shifting.

In the roller steering type, amounts of steering of the steering rollers 77 and 78 are properly controlled and timed, so that the latent belt shifting of the intermediary transfer belt 31 can be within the supporting range by the rotatable members. Further, it is possible to regulate the lateral belt shifting without application of stress to the intermediary transfer belt 31.

For this reason, in an image forming apparatus which is required to have durability to some extent and has high productivity, the steering mechanism of such a roller steering type has been used frequently.

<Steering Control>

Figure 2:
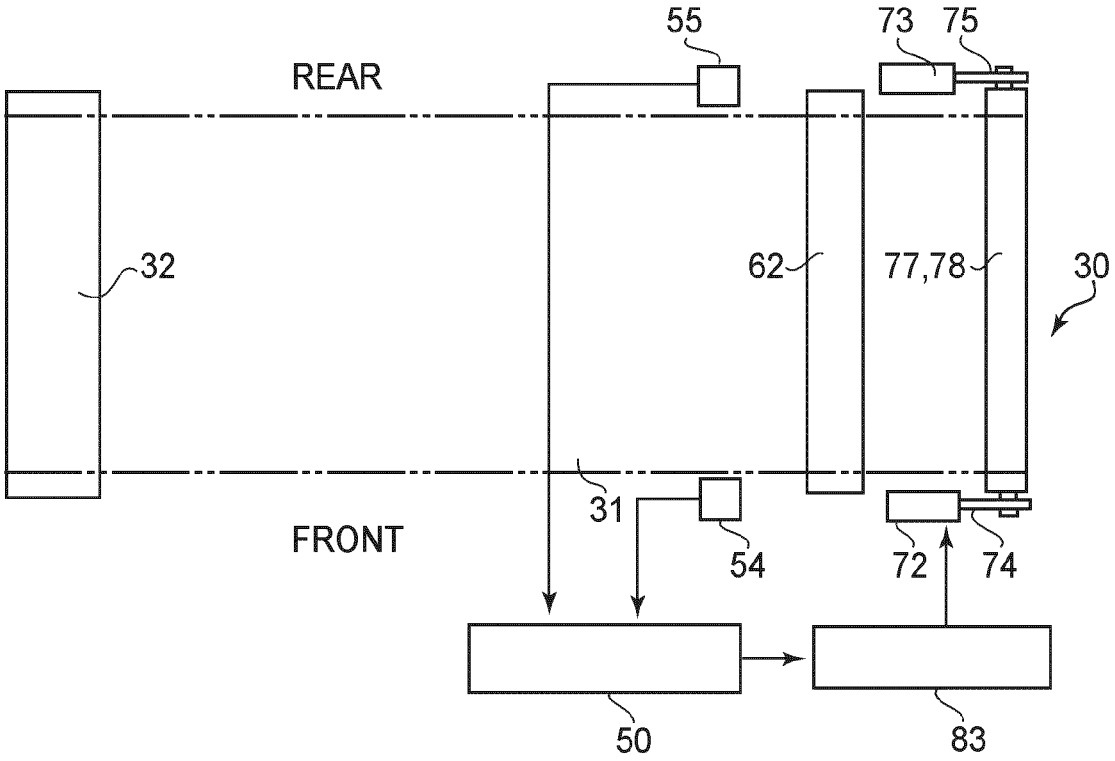
FIG. 2 is a schematic view for illustrating a steering control system for an intermediary transfer belt.

FIG. 2 is a schematic view for illustrating a steering control system for the intermediary transfer belt 31.

As shown in FIG. 2 with reference to FIG. 1, a control portion 50 actuates a steering mechanism 30 based on an output of belt edge sensors 54 and 55 to locate a rotational position of the intermediary transfer belt 31 with respect to a width direction of the intermediary transfer belt 31.

The belt edge sensors 54 and 55 input an analog voltage, depending on an angle of rotation of a flag contacting the edge of the belt, to the control portion 50.

The control portion 50 is constituted by a control substrate for controlling an operation of a mechanism in each of units for the image forming apparatus 100, and a motor drive substrate and the like.

The control portion 50 actuates the steering mechanism 30 when approach of the belt edge is detected by the belt edge sensor 54, thus moving the intermediary transfer belt 31 toward a rear side. At this time, the control portion 50 actuates a pulse motor 83 to lower front side rotation shaft ends of the steering rollers 77 and 78. As a result, a position of end of contact (winding) of the intermediary transfer belt 31 with (about) the steering roller 78 is shifted toward the rear side compared with a position of start of contact of the intermediary transfer belt 31 with the steering roller 77, so that the rotating intermediary transfer belt 31 is gradually moved toward the rear side.

The control portion 50 actuates the steering mechanism 30 when approach of the belt edge is detected by the belt edge sensor 55, thus moving the intermediary transfer belt 31 toward a front side. At this time, the control portion 50 actuates a pulse motor 83 to raise front side rotation shaft ends of the steering rollers 77 and 78. As a result, a position of end of contact (winding) of the intermediary transfer belt 31 with (about) the steering roller 78 is shifted toward the front side compared with a position of start of contact of the intermediary transfer belt 31 with the steering roller 77, so that the rotating intermediary transfer belt 31 is gradually moved toward the front side.

The steering mechanism 30 rotates the steering rollers 77 and 78 so as to contact the inner surface of the intermediary transfer belt 31 in a section defined by supporting rollers 62 and 63. The steering mechanism 30 positions the rotating intermediary transfer belt 31 in the width direction by changing inclination angles of the steering rollers 77 and 78 with respect to the rotational direction of the intermediary transfer belt 31 in the same direction.

The supporting rollers 62 and 63 are disposed to sandwich the steering rollers 77 and 78 along the rotational direction of the intermediary transfer belt 31. The inclination angles of the steering rollers 77 and 78 are controlled within a range in which the intermediary transfer belt 31 is not moved apart from the supporting rollers 62 and 63.

The supporting roller 62 blocks inclination of the intermediary transfer belt 31 resulting from inclination of the steering roller 77 to form a certain transfer surface between the supporting roller 62 and the driving roller 32. The supporting roller 63 blocks inclination of the intermediary transfer belt 31 resulting from inclination of the steering roller 78 to keep the surface of the intermediary transfer belt 31 on the secondary transfer portion T2 side at a constant level.

<Steering Mechanism>

Figure 3:
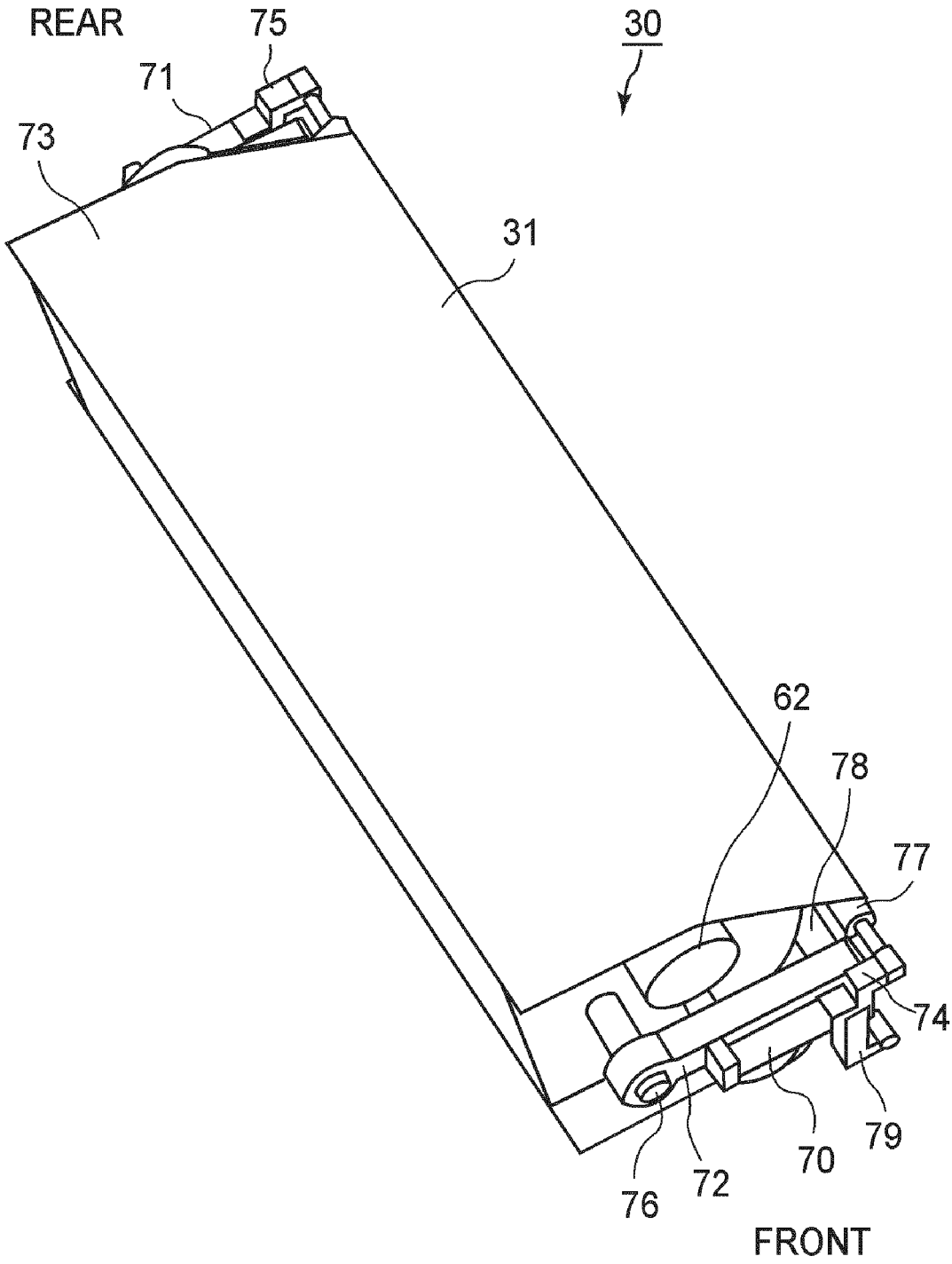
FIGS. 3, 4 and 5 are schematic perspective, front and rear views, respectively, of a steering mechanism.
Figure 4:
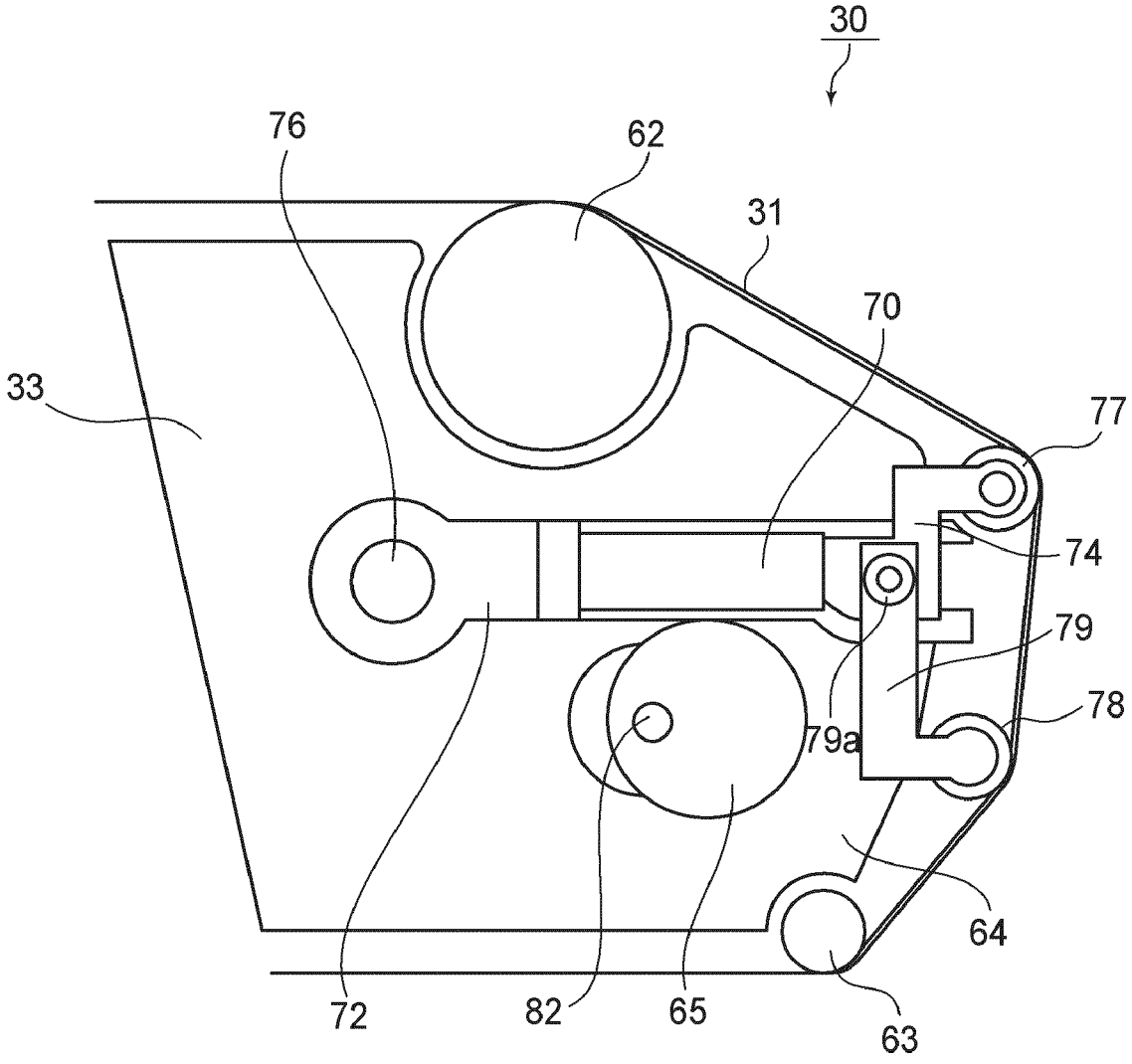
Figure 5:
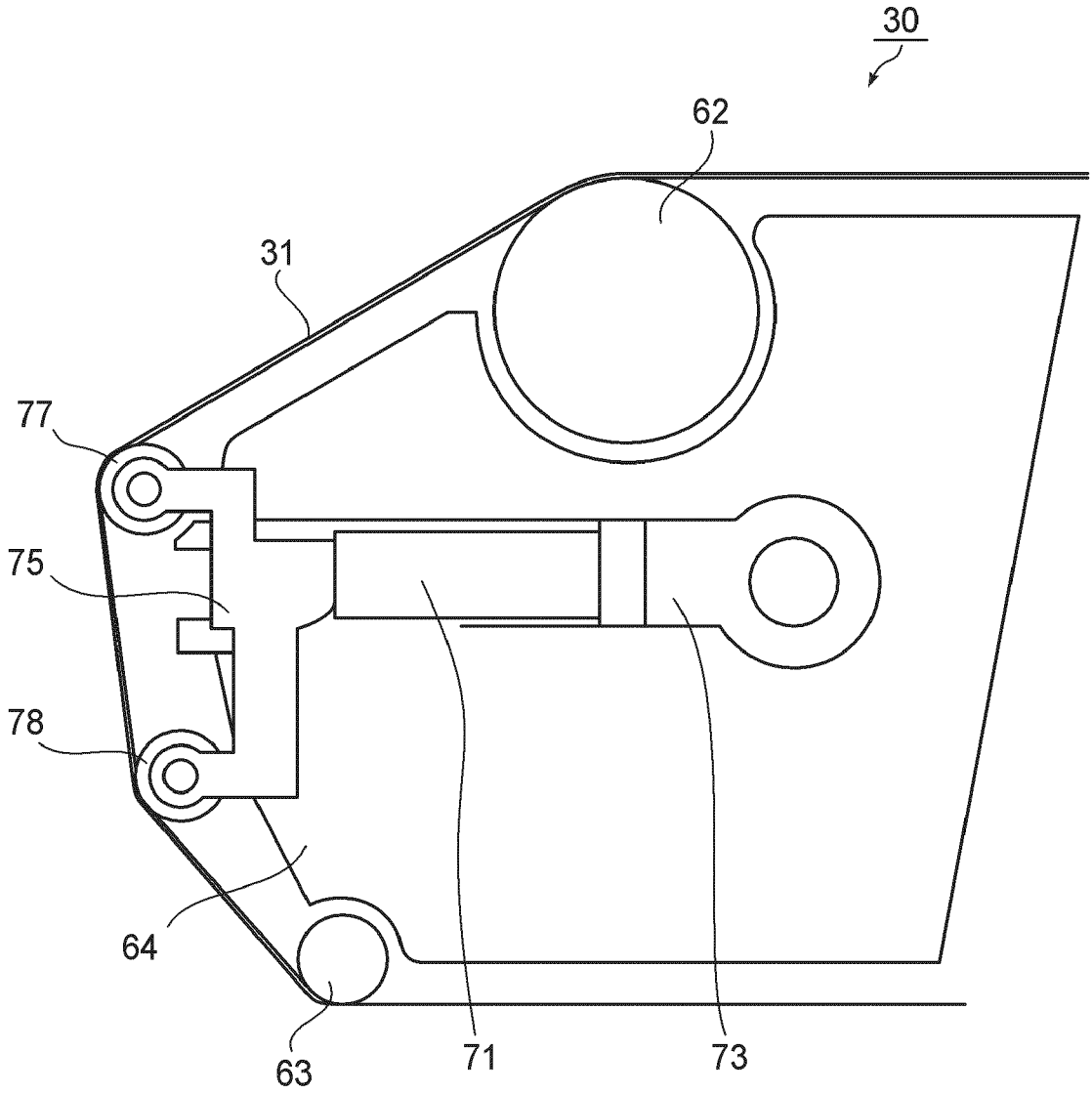
Figure 6:
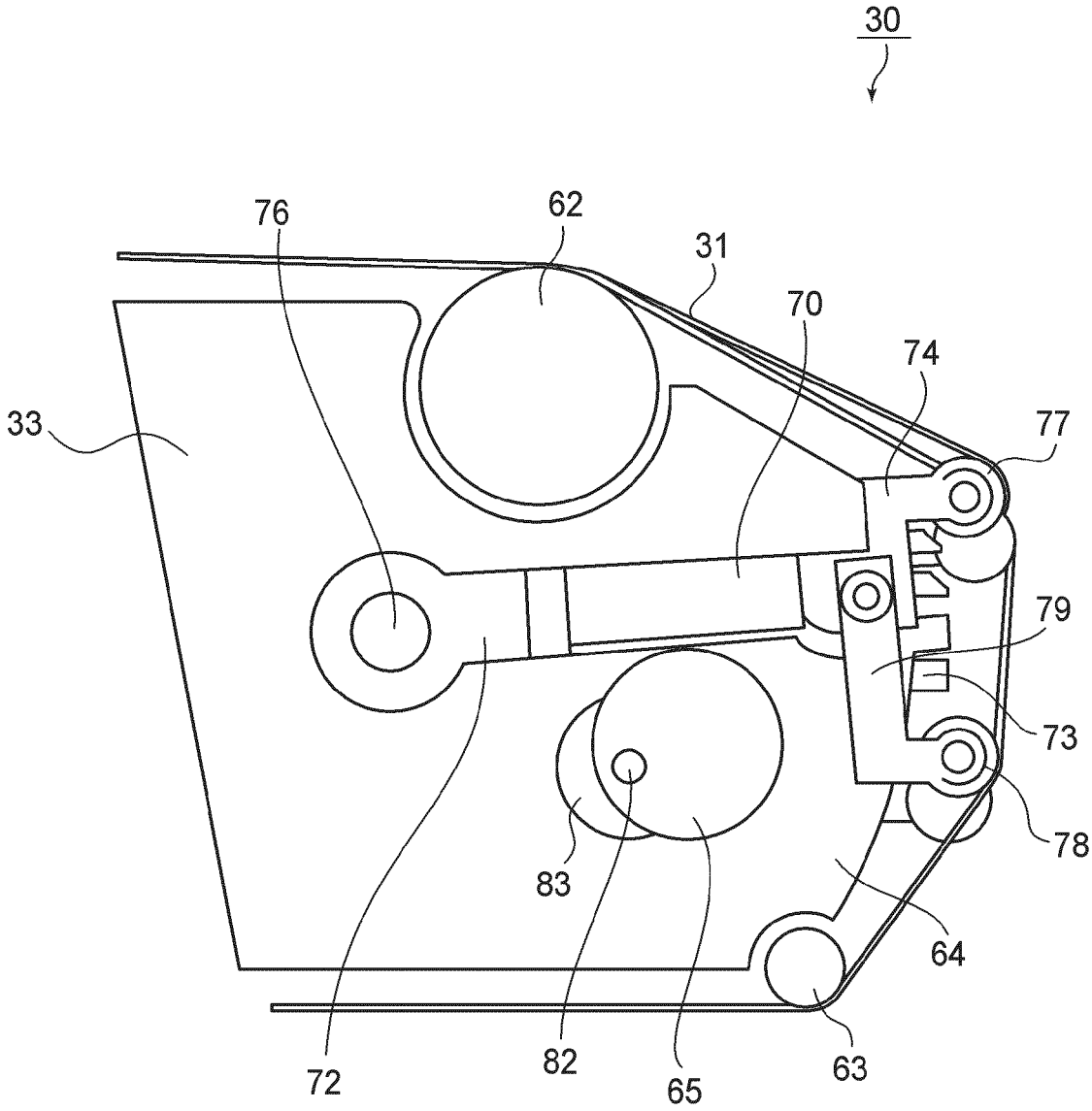
FIG. 6 is a schematic view for illustrating an operation of the steering mechanism.

FIGS. 3, 4 and 5 are schematic perspective, front and rear views, respectively, of the steering mechanism. FIG. 6 is a schematic view for illustrating an operation of the steering mechanism.

As shown in FIG. 3, the steering mechanism 30 moves the intermediary transfer belt 31 in its width direction by changing the inclination angles of the steering rollers 77 and 78 with respect to the rotational direction of the intermediary transfer belt 31.

The steering roller 77 is held by a bearing arm 74 at its front side rotation shaft end and by a bearing arm 75 at its rear side rotation shaft end, thus being rotatable. The bearing arm 74 is slidably held by a holding arm 72 with respect to a direction along the holding arm 72.

The steering roller 78 rotates while stretching the intermediary transfer belt 31 between the steering rollers 77 and 78. The steering roller 78 is held by a bearing arm 79 fixed to the bearing arm 74 at its front side rotation shaft end and by the bearing arm 75 at its rear side rotation shaft end, thus being rotatable. The bearing arm 75 is slidably held by a holding arm 73 with respect to the direction along the holding arm 73.

The bearing arms 74 and 75 are rotatably held by the holding arms 72 and 73 in a plane perpendicular to the directions along the holding arms 72 and 73. Therefore, the steering rollers 77 and 78 change their inclination angles while maintaining a rectangular shape constituted by the steering rollers 77 and 78 and the bearing arms 74, 75 and 79.

Thus, interrelating portions (72, 74, 79, 73, 75) include rotatable members (72, 74 and 79) which rotatably support a first rotatable steering member (77) and a second rotatable steering member (78) at their rotation ends and move the rotation ends by rotational movement.

As shown in FIG. 4, the front side holding arm 72 is rotatably attached to a rotation shaft 76 fixed to a unit frame 64 and is urged by an unshown spring in a clockwise direction, so that a lower surface of the front side holding arm 72 contacts a cam 65. Therefore, a rotation position of the holding arm 72 around the rotation shaft 76 is determined by a projection height of the holding arm 72 from a cam surface of the cam 75.

An urging spring 70 is disposed between the bearing arm 74 and the holding arm 72 to urge the bearing arm 74 toward an outside direction along the holding arm 72. As a result, the urging spring 70 pushes the bearing arms 74 and 79 outwardly to cause the steering rollers 77 and 78 to press-contact the inner surface of the intermediary transfer belt 31, thus imparting a necessary tension to the front side of the intermediary transfer belt 31.

As shown in FIG. 5, on the other hand, the rear side holding arm 74 is fixed and supported by the unit frame 64, so that a rotational movement operation of the rear side holding arm 74 is not performed.

An urging spring 71 is disposed between the bearing arm 75 and the holding arm 73 to urge the bearing arm 75 toward an outside direction along the holding arm 73. As a result, the urging spring 71 pushes the bearing arm 75 outwardly to cause the steering rollers 77 and 78 to press-contact the inner surface of the intermediary transfer belt 31, thus imparting a necessary tension to the rear side of the intermediary transfer belt 31.

As shown in FIG. 4, the bearing arm 79 is fixed to the bearing arm 74 via an alignment adjusting mechanism 79*a*. For this reason, by loosening the adjusting mechanism 79*a*, one of the rotation shaft ends of the steering roller 78 is moved in the direction along the holding arm 72 (a projection length toward the belt member) and a direction toward the steering roller 77 (a distance between shaft ends), thus being fixable. The alignment adjusting mechanism 79*a* is adjusted so that relative alignment states of the steering rollers 77 and 78 substantially coincide with each other.

On the surfaces of the steering rollers 77 and 78, a rubber layer is formed so as to maintain a good gripping state with respect to the belt.

As shown in FIG. 6, the holding arm 72 is rotationally moved by actuating the pulse motor 83 to rotate the cam 65 to raise and lower the steering rollers 77 and 78 on their front sides. At this time, the steering rollers 77 and 78 are not raised and lowered on their rear sides.

Figure 7:
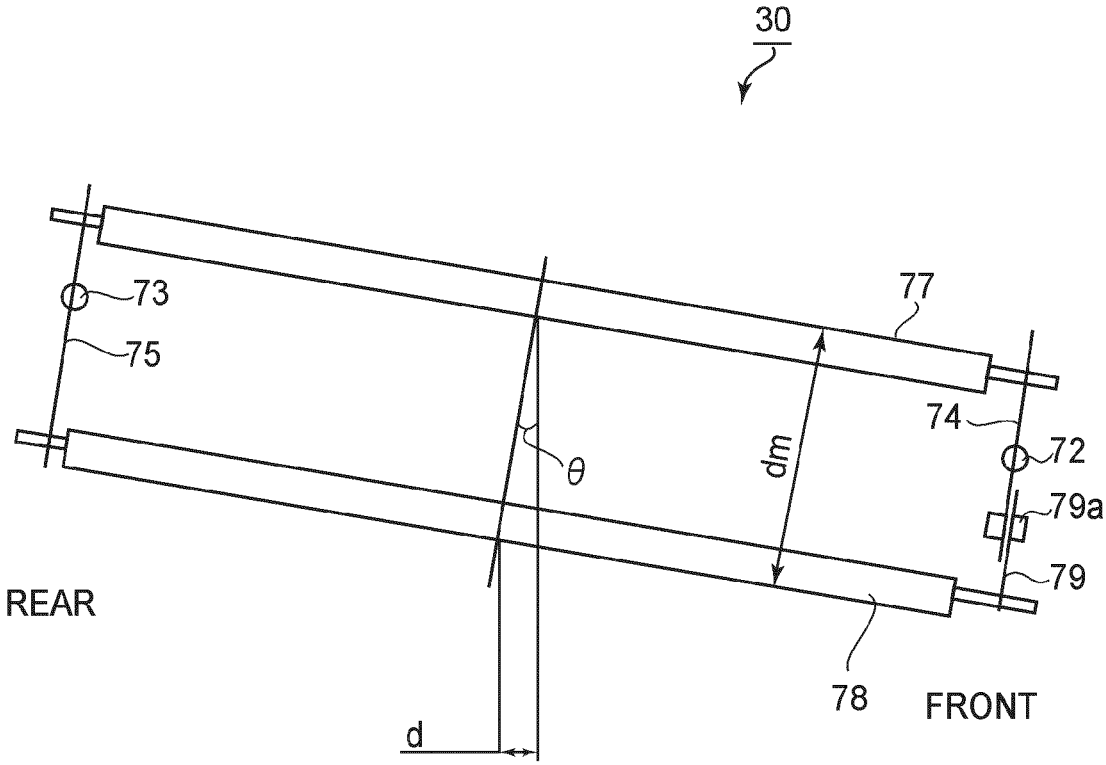
FIG. 7 is a schematic view for illustrating a steering performance of a steering roller.

As shown in FIG. 7, the steering rollers 77 and 78 change an inclination angle with respect to the rotational direction of the intermediary transfer belt (31: FIG. 3) while a relative positional relationship between the steering rollers 77 and 78 is fixed (without shifting in the shaft direction).

As a result, a difference in relative position between the front side holding arm 72 and the rear side holding arm 73 is caused, so that the steering rollers 77 and 78 are steered. The steering rollers 77 and 78 are satisfactorily adjusted in relative alignment therebetween, so that the same constraint conveyance direction of the intermediary transfer belt 31 is kept. Further, a good belt gripping state is retained by the rubber layer which has been subjected to surface treatment, so that constraint conveyance of the belt toward the steering direction including a stretching portion between the steering rollers 77 and 78.

As a result, an inclination angle θ is provided for a distance dm from the start of contact of the intermediary transfer belt 31 with the steering roller 77 to the end of contact of the intermediary transfer belt 31 with the steering roller 78. Further, a thrust movement distance d of the intermediary transfer belt 31 at the belt contact portion of the steering rollers is provided. As a result, it is possible to provide a latent belt shifting speed, with high sensitivity, depending on the angle of rotation of the cam 65 to the intermediary transfer belt 31.

In this embodiment, the intermediary transfer belt 31 is used as the belt member but the present invention is also suitably applicable to other belt conveying means provided with a steering mechanism, such as the fixing device and the like.

Comparative Embodiment 1

Figure 8:
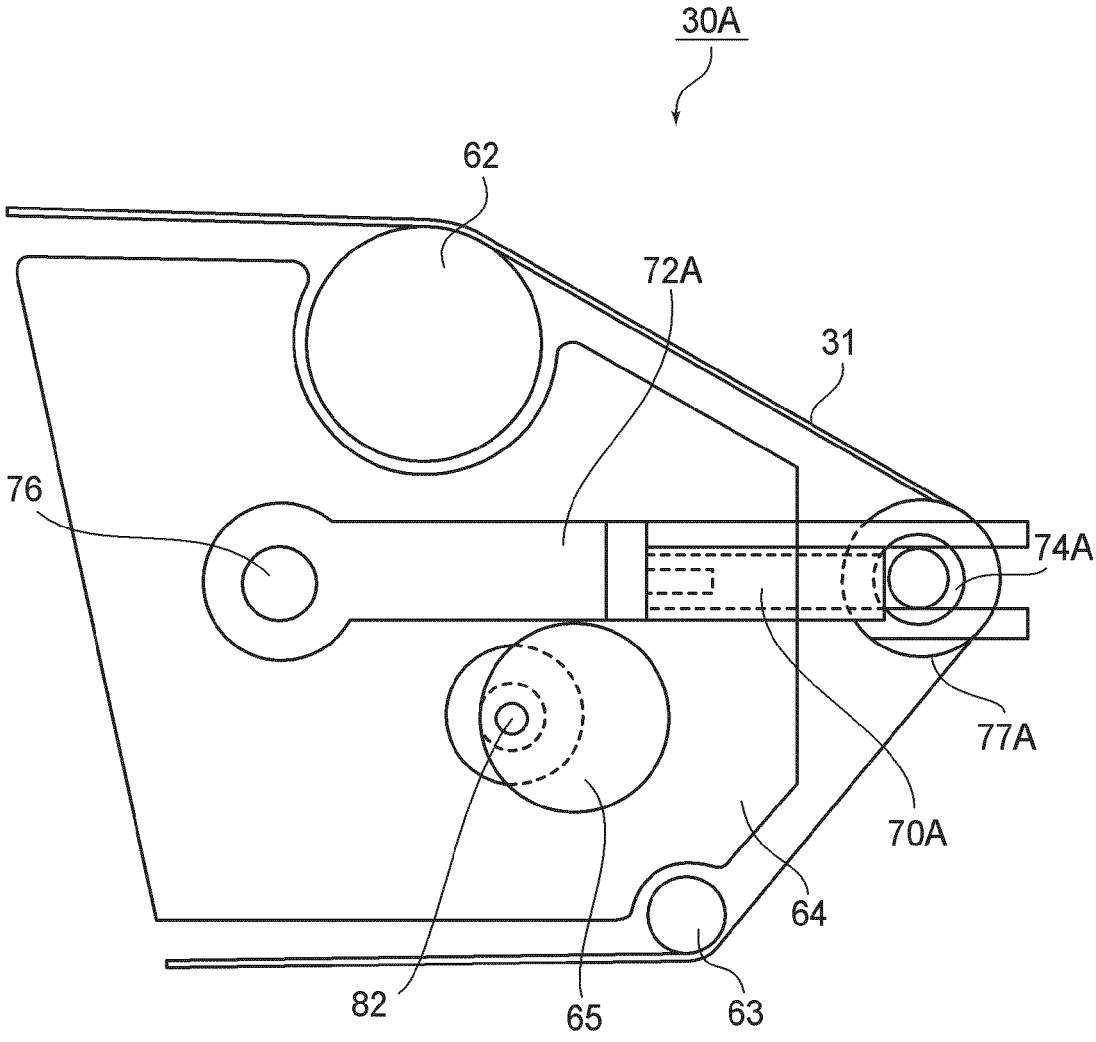
FIG. 8 is a front view of a steering mechanism in Comparative Embodiment 1.
Figure 9:
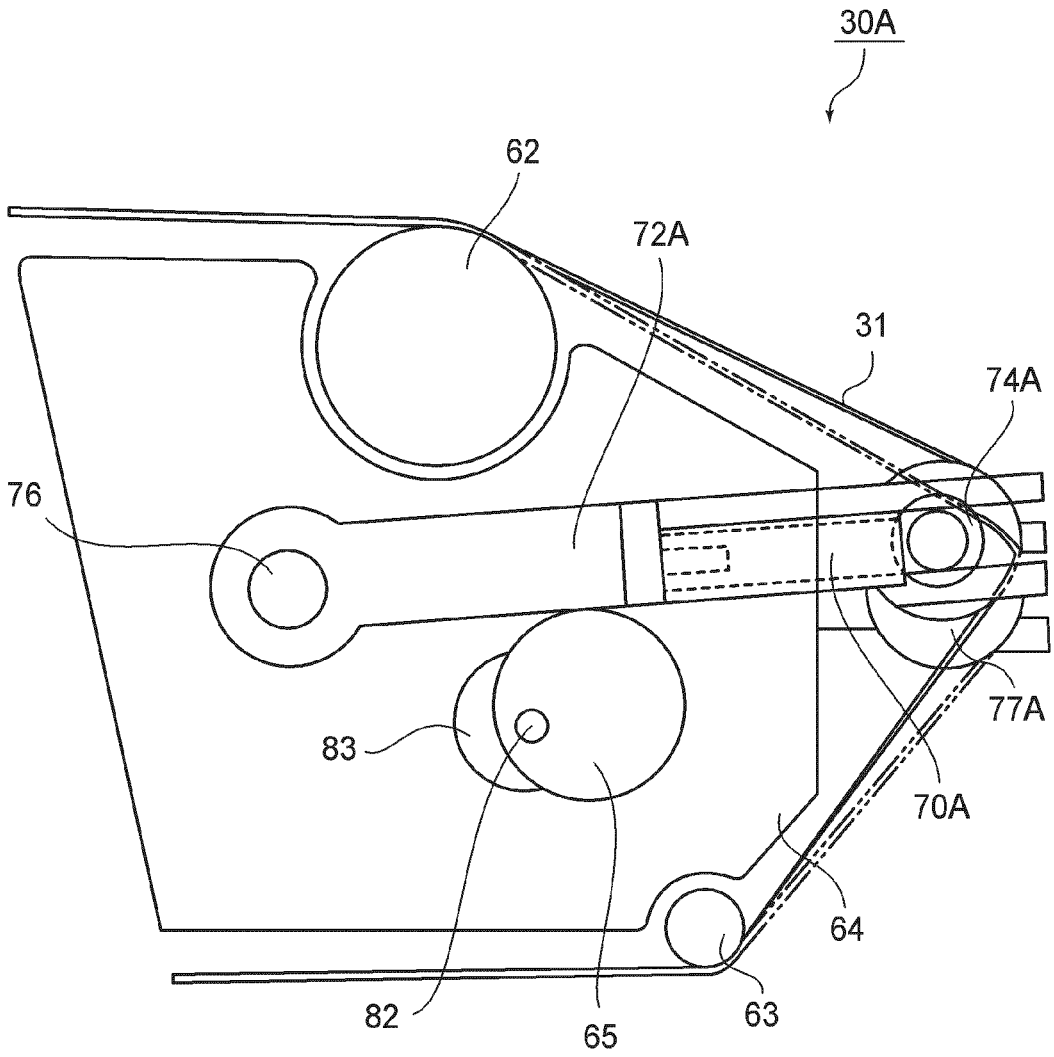
FIG. 9 is a schematic view for illustrating an operation of the steering mechanism in Comparative Embodiment 1.
Figure 10:
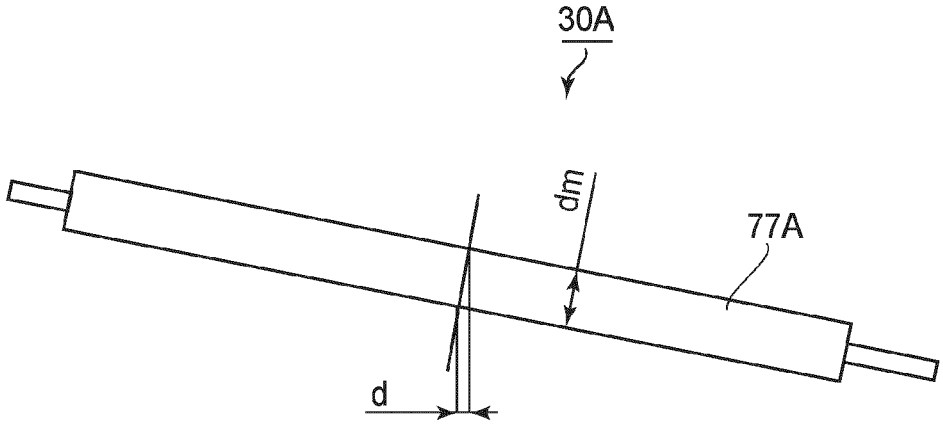
FIG. 10 is a schematic vie for illustrating a steering performance of a steering roller.
Figure 11:
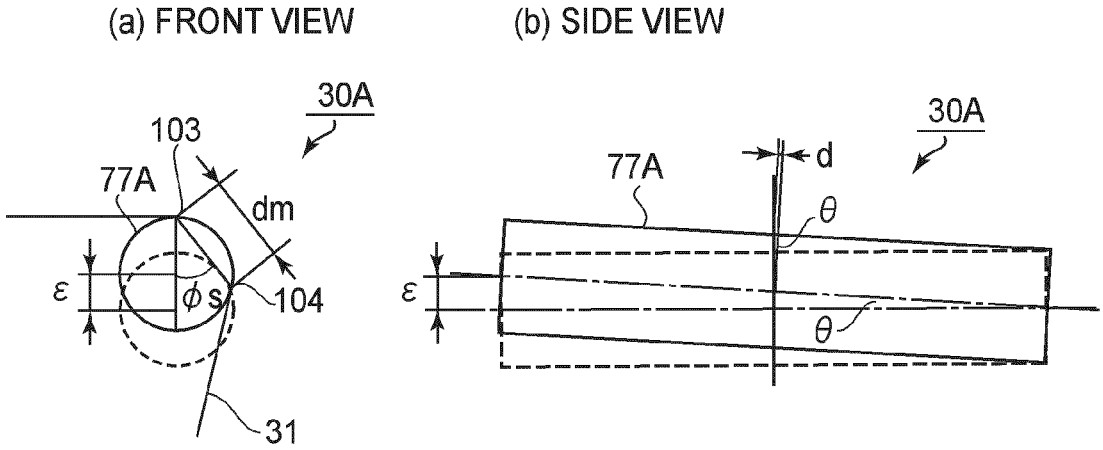
FIGS. 11(*a*) and 11(*b*) are schematic views for illustrating a belt movement distance.

FIG. 8 is a front view of the steering mechanism in Comparative Embodiment 1. FIG. 9 is a schematic view for illustrating an operation of the steering mechanism in Comparative Embodiment 1. FIG. 10 is a schematic view for illustrating a steering performance of the steering roller. FIGS. 11(*a*) and 11(*b*) are schematic views for illustrating a belt movement distance.

In Comparative Embodiment 1, the steering rollers 77 and 78 of the steering mechanism 30 as shown in FIG. 3 are replaced with a single conventional steering roller 77A having a large diameter.

As shown in FIG. 8, in a steering mechanism 30A in Comparative Embodiment 1, the intermediary transfer belt 31 is steered by the single steering roller 77A having the large diameter disposed between the supporting rollers 62 and 63.

A front-side holding arm 72A is rotatably attached to the rotation shaft 76 and contacts the cam 65 at its lower surface, so that the rotational movement position of the holding arm 72A is determined by the projection height of the holding arm 72A from the cam 65.

A bearing arm 74A is slidably held by the holding arm 72A and an urging spring 70A is disposed between the bearing arm 74A and the holding arm 72A to urge the bearing arm 74A outwardly. As a result, a necessary tension is imparted to the front side of the intermediary transfer belt 31.

On the rear side of the steering mechanism 30A< a rotation shaft end of the steering roller 77A is held with respect to a horizontal direction and is urged outwardly by an urging spring (71A: not shown).

As shown in FIG. 9, the pulse motor 83 is actuated to rotationally drive a cam shaft 82 at a predetermined angle, so that the front side holding arm 72A is rotationally moved by the action of the cam 65 to raise the front side rotation shaft end of the steering roller 77A.

At this time, as shown in FIG. 10, a belt thrust movement distance d is considerably decreased even when an amount of rotation of the cam shaft 82 is provided so as to be equal to that in the case of the constitution of FIG. 6.

As shown in FIG. 11(*b*), a steering function of the steering roller 77A changes an inclination angle θ of the steering roller 77A with respect to the rotational direction of the intermediary transfer belt 31.

As shown in FIG. 11(*a*), the intermediary transfer belt 31 is moved in its width direction by causing longitudinal roller displacement (belt thrust movement distance d) between a contact start point 103 and a contact end point 104 of the intermediary transfer belt 31 with the steering roller 77A.

As shown in FIG. 11(*b*), the intermediary transfer belt 31 obtains this thrust movement distance d every one full circumference, so that the intermediary transfer belt 31 is successively moved in the shaft direction of the steering roller 77A. By controlling this thrust movement distance d by a movement distance ϵ of an end portion of the steering roller 77A (hereinafter referred to as a "steering amount ϵ"), steering control of the intermediary transfer belt 31 can be carried out.

As shown in FIG. 11(*a*), a distance between the contact start point 103 and the contact end point 104 is taken as dm. An angle formed between a direction of the distance dm and the steering direction is taken as ϕs and a length of the steering roller 77A is taken as ks. In this case, between the belt steering amount ϵ and the thrust movement distance d of the intermediary transfer belt 31 by the steering roller 77A, the following relationship (1) is satisfied.

$$d=\epsilon\times dm/ks\times\cos(\phi s) \quad (1)$$

Therefore, in order to increase the thrust movement distance d, it is necessary to increase the diameter of the steering roller 77A and the angle of contact of the intermediary transfer belt 31 to increase the distance dm.

However, as shown in FIG. 1, there is the case where the steering roller 77A having a sufficient diameter cannot be disposed due to cross-sectional constraints or the case where a sufficient contact angle with respect to the steering roller 77A cannot be ensured.

In these cases, a value of the distance dm is small, so that the thrust movement distance d for the steering control is insufficient. As a result, overshooting of the intermediary transfer belt 31 can occur.

Further, in the case where the thrust movement distance d is intended to be increased when the distance dm is small, this results in an increase in steering amount ϵ of the steering roller 77A. In this case, large image distortion can occur and the steering roller 77A cannot constrain the intermediary transfer belt 31 due to tension of the intermediary transfer belt 31. As a result, inconvenience of the steering control is caused in some cases.

Comparative Embodiment 2

Figure 12:
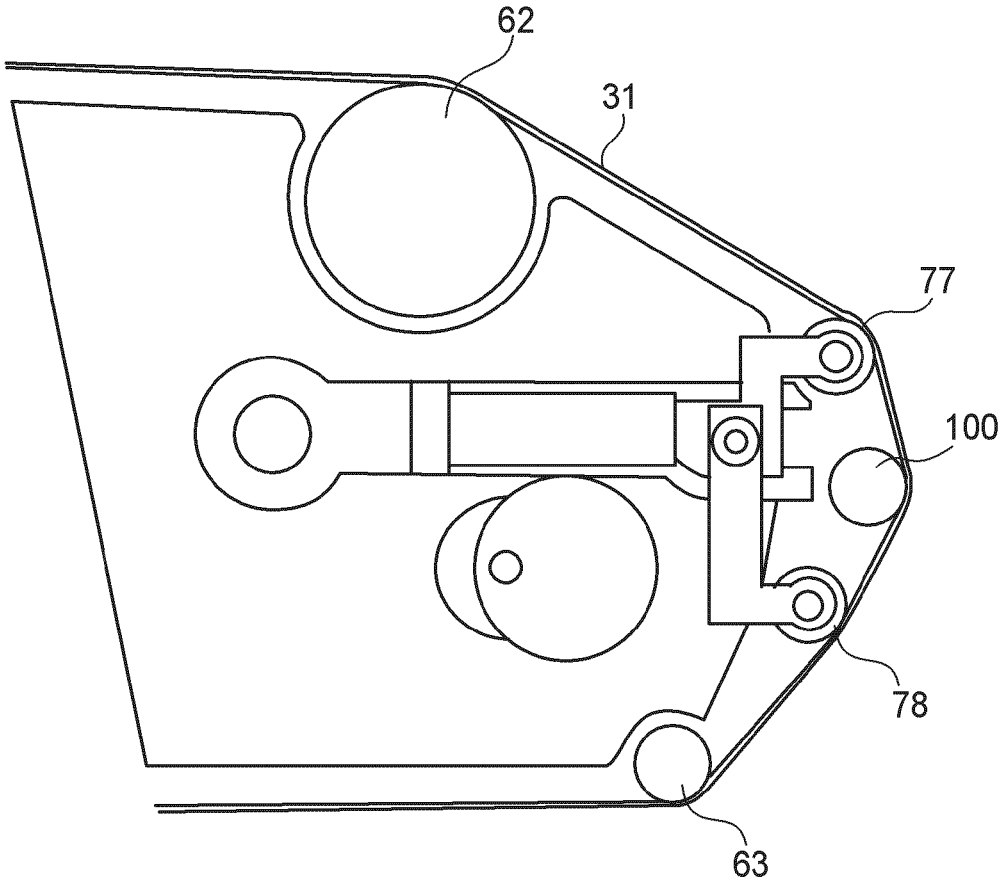
FIG. 12 is a front view of a steering mechanism in Comparative Embodiment 2.
Figure 13:
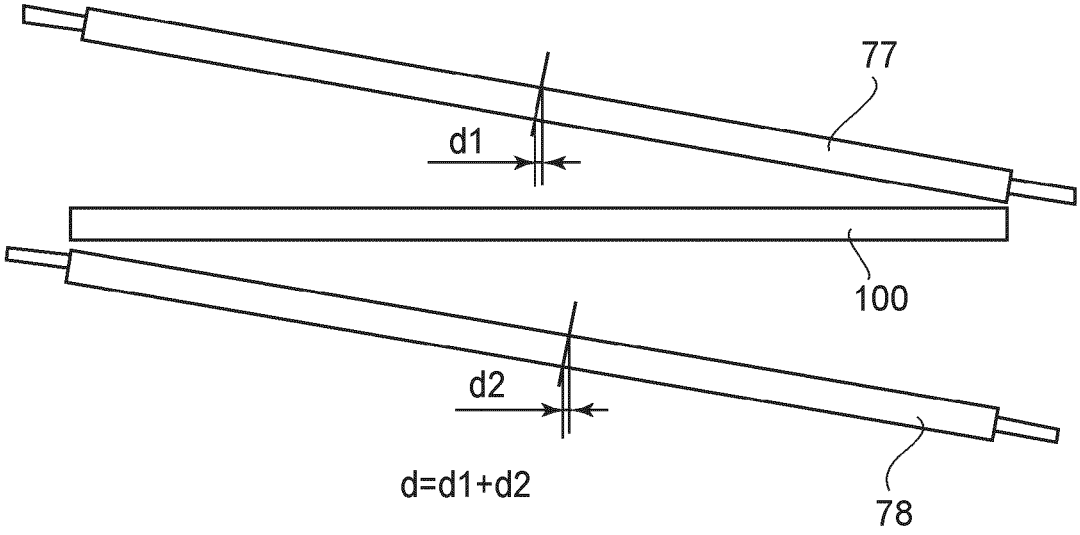
FIG. 13 is a schematic view for illustrating a steering performance of steering rollers.

FIG. 12 is a front view of a steering mechanism in Comparative Embodiment 2 and FIG. 13 is a schematic view for illustrating a steering performance of steering rollers.

In Comparative Embodiment 2, between the steering rollers 77 and 78 described in the First Embodiment, a supporting roller 100 which is not interrelated with the steering rollers 77 and 78 with respect to the inclination angle is disposed.

As shown in FIG. 12, in the case where non-adjacent steering rollers 77 and 78 are steered, as shown in FIG. 13, a resultant thrust movement distance d is considerably decreased when compared with the case of the First Embodiment as shown in FIG. 7.

This is because the supporting roller 100 which is not interrelated with the steering rollers 77 and 78 with respect to alignment change is disposed between the steering rollers 77 and 78 to cause out-of-plane deformation of the belt at a portion contacting the supporting roller 100. Further, upward movement or the like of the intermediary transfer belt 31 on one end side of the supporting roller 100 is caused to occur, so that vectors of the steering rollers 77 and 78 with respect to the belt conveyance direction cannot be kept.

On the other hand, the steering mechanism 30 in the First Embodiment can realize a belt conveying constitution capable of performing good belt conveyance with a small space, a simple constitution, and a large lateral belt shifting control image.

The reasons for this effect are as follows.

As shown in FIG. 7, in the case where the intermediary transfer belt 31 is steering-controlled by the interrelation with the steering rollers 77 and 78, the distance from the start of belt contact with the steering roller 77 to the end of belt contact with the steering roller 78 can be regarded as the distance dm represented by the above-described relationship (1). However, in this case, the steering rollers 77 and 78 are required to have a sufficient belt constraint force and provide good relative alignment therebetween.

The belt member, such as the intermediary transfer belt, a recording material conveying belt, or a fixing belt, used in the image forming apparatus includes a base layer formed of polyimide (PI) which cannot extend largely in many cases.

Such a belt member can easily cause out-of-plane deformation but causes little in-plane deformation.

For this reason, the intermediary transfer belt 31 conveyed from the end point of belt contact with the steering roller 77 is placed in a constraint state with respect to this conveyance direction. During effective constraint when the intermediary transfer belt 31 is caused to contact with the steering roller 78 having the same conveyance direction as the case of the steering roller 77, a portion of the intermediary transfer belt 31 between the steering rollers 77 and 78 can also be constrained along conveyance vectors of the steering rollers 77 and 78 by cooperation of the steering rollers 77 and 78. As a result, it is possible to obtain a large distance dm from the start of belt contact with the steering roller 77 and the end of belt contact with the steering roller 78 in a small space.

Therefore, it is very important to adjust the conveyance vectors of the steering rollers 77 and 78 so as to be directed in the same direction. In the First Embodiment, these conveyance vectors are fixable by adjusting a distance between the rotation shaft end of the first rotatable steering member and the rotation shaft end of the second rotatable steering member and a distance between the rotation shaft of the rotatable member and the rotation shaft end of the second rotatable steering member by providing the alignment adjusting mechanism 79*a*. For this reason, it is possible to uniformize the conveyance vectors of the steering rollers 77 and 78 precisely and easily when the rotatable members are assembled by using jigs.

It is also very important that the steering rollers 77 and 78 have a sufficient belt constraint force. In the First Embodiment, the steering rollers 77 and 78 are subjected to surface treatment of the rubber layer so that a friction coefficient thereof is higher than those of other (a plurality of) rotatable members.

As described above, according to the present invention, it is possible to increase the widthwise movement distance of the belt member with respect to the inclination angle of the rotatable steering members without relying on the angle of contact of the belt member and the diameter of the rotatable steering members.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 328856/2007 filed Dec. 20, 2007, which is hereby incorporated by reference.

What is claimed is:

1. An apparatus comprising:

a rotatable belt member;

a rotatable supporting member for supporting said belt member;

a first rotatable steering member for adjusting a position of said belt member with respect to a rotational axis direction of said supporting member by contacting an inner surface of said belt member and inclining with respect to the rotational axis direction of said supporting member;

a second rotatable steering member for adjusting the position of said belt member with respect to the rotational axis direction of said supporting member by contacting the inner surface of said belt member and inclining with respect to the rotational axis direction of said supporting member;

a connecting portion for connecting said first rotatable steering member and said second rotatable steering member with each other; and an interrelating mechanism for interrelating an inclining operation of said first rotatable steering member and an inclining operation of said second rotatable steering member with each other so that said first rotatable steering member and said second rotatable steering member incline in the same direction by said connecting portion.

2. An apparatus according to claim 1, wherein said interrelating mechanism fixes a positional relationship between said first rotatable steering member and said second rotatable steering member.

3. An apparatus according to claim 1, wherein said interrelating mechanism includes an adjusting mechanism for adjusting a distance between one shaft end of said first rotatable steering member and associated one shaft end of said second rotatable steering member so that a positional relationship between said first rotatable steering member and said second rotatable steering member is fixable.

4. An apparatus according to claim 1, wherein said interrelating mechanism includes an adjusting portion for adjusting a difference in projection length toward said belt member between said first rotatable steering member and said second rotatable steering member at their one shaft ends.

5. An apparatus according to claim 1, wherein each of said first rotatable steering member and said second rotatable steering member has a surface having a friction coefficient larger than those of other rotatable members.

6. An apparatus according to claim 1, wherein said interrelating mechanism rotatably supports said first rotatable steering member and said second rotatable steering member with a rotatable end of a rotatable member for moving the rotatable end by rotational movement.

* * * * *